United States Patent [19]
Romain
[11] 4,318,233
[45] Mar. 9, 1982

[54] POWERED LIQUID INLET SCREEN

[76] Inventor: Bernard F. Romain, 504 S. Meadow, Grangeville, Id. 83530

[21] Appl. No.: 150,442

[22] Filed: May 16, 1980

[51] Int. Cl.[3] ..... E02F 3/88
[52] U.S. Cl. ..... 37/57; 37/64
[58] Field of Search ..... 37/57, 67, 64, 54, 56, 37/58, 61–63, 65; 299/9, 8

[56] References Cited

U.S. PATENT DOCUMENTS

| | | | |
|---|---|---|---|
| 484,763 | 10/1892 | Bowers | 37/67 |
| 637,831 | 11/1899 | Robinson | 37/67 |
| 1,994,884 | 3/1935 | Chew | 37/57 X |
| 2,017,296 | 10/1935 | Smith | 37/67 |
| 2,040,303 | 5/1936 | Gaylord | 37/67 |
| 2,242,520 | 5/1941 | Grundborg | 37/67 |
| 2,605,090 | 7/1952 | Jacobsen | 37/63 X |
| 2,774,569 | 12/1956 | Jacobsen | 37/57 X |
| 3,136,583 | 6/1964 | Griffin | 37/67 |

*Primary Examiner*—Clifford D. Crowder
*Attorney, Agent, or Firm*—Wells, St. John & Roberts

[57] ABSTRACT

A liquid inlet adapted to fit over the intake end of a suction hose for a portable dredging machine. The inlet is elbow shaped, having a discharge end mountable to the dredging machine suction hose. The opposite end of the inlet includes a set of spiral-shaped fingers that are powered to rotate in front of an open intake end. The fingers are rotated by a hand-held drive motor on a shaft that passes through a portion of the elbow. The rotating fingers strain material drawn into the elbow and suction hose and deflect material that could otherwise clog the suction hose.

5 Claims, 5 Drawing Figures

POWERED LIQUID INLET SCREEN

BACKGROUND OF THE INVENTION

The present invention is related to the liquid inlet of small, portable dredges having hand-operated flexible suction hoses.

The suction hoses of small, portable dredges are relatively small and can easily become clogged during use. Attempts to keep the suction hose clear have conventionally involved the use of various screens and filter arrangements. Such devices must be cleaned often and are not entirely effective in keeping the hose clear. Long, narrow stones or twigs can be drawn through the stationary openings in such screens and pass into the suction hose.

The above problem has been solved to a limited degree for large industrial dredges as exemplified by U.S. Pat. No. 2,242,520 to Grundborg. The Grundborg dredge is supported on a barge and makes use of a barge supported power source for producing suction through a rigid, pivoted intake pipe. The open end of the pipe is enclosed by an "egg beater" shaped rotating screen. The screen is fitted over the intake end of the pipe. The base is rotated by a complex drive line extending the length of the pipe to the main power source. The screen is comprised of a number of knives that converge outwardly from the pipe opening. The knives serve a twofold purpose. First, they are used to chop through material on the bottom surface and can dig through compacted material. Secondly, the knives are used as strainers. They are rigid for the digging function and therefore can bind against large stones having projections that will fit between adjacent knives.

The power requirements, drive line and digger configuration, of the Grundborg dredge cannot be adapted for use in smaller, portable dredges presently in wide use by independent prospectors.

The present invention eliminates suction hose clogging problems through the use of a hand held liquid inlet with powered fingers rotating across an open intake. The fingers diverge from a point ahead of the suction hose opening to free ends situated radially outward and adjacent the intake opening. The fingers are spiral shaped to engage and deflect oversize material from the intake, while allowing free passage of proper size material. The fingers are rotated by a hand-held drive unit mounted directly to the fingers. Rearward ends of the fingers are free (unlike those of the Grundborg device) and will not become clogged by passage of rearwardly moving material.

DETAILED DESCRIPTION OF A PREFERRED EMBODIMENT

Figure 4:
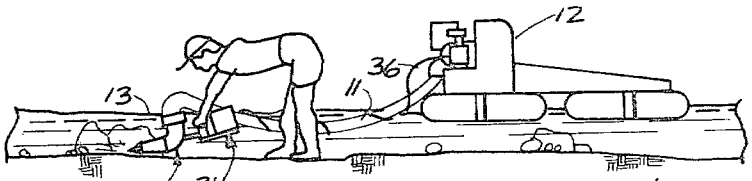
FIG. 4 is a diagrammatic view showing the present invention in operation.

FIG. 4 generally shows the present liquid inlet at 10 being used in conjunction with the suction hose 11 of a standard portable dredging machine 12. The dredging machine 12 is shown without substantial detail, it being understood that various forms of such portable dredging machines are currently available and that many different forms can be used in conjunction with the present invention. The dredge will usually have some form of flotation apparatus to support the machine and its associated components at the surface of the body of water. The suction hose 11 leads from a pump on the machine 12 to an intake end 13. The conventional intake end 13 is supplied with some form of stationary screen or is left open. It is hand-held for placement directly adjacent loose material to be drawn through hose 11 to the dredge.

The present inlet 10 is adapted to be mounted to the suction hose 11 at the intake end 13 for allowing passage of limited sized material into the suction hose, while preventing passage of larger or elongated material that would ordinarily clog the hose somewhere along its length or otherwise inhibit efficient use of the machine.

The present machine makes use of an elbow shaped tubular housing 15 having a rear discharge end 16 that is adapted to be mounted to the outer end of suction hose 11. The end 16 is flanged and can be fitted with set screws, clamps, or other devices that will secure the elbow to the hose intake end 13. Elbow 15 is generally L-shaped, having two perpendicular legs. The illustrated upright leg includes the rear discharge end 16 while a substantially horizontal leg includes a forward intake end 18. The intake end 18 includes a forwardly facing opening 20 (FIG. 5) through which material is received and directed through the elbow and into the suction hose 11.

Figure 5:
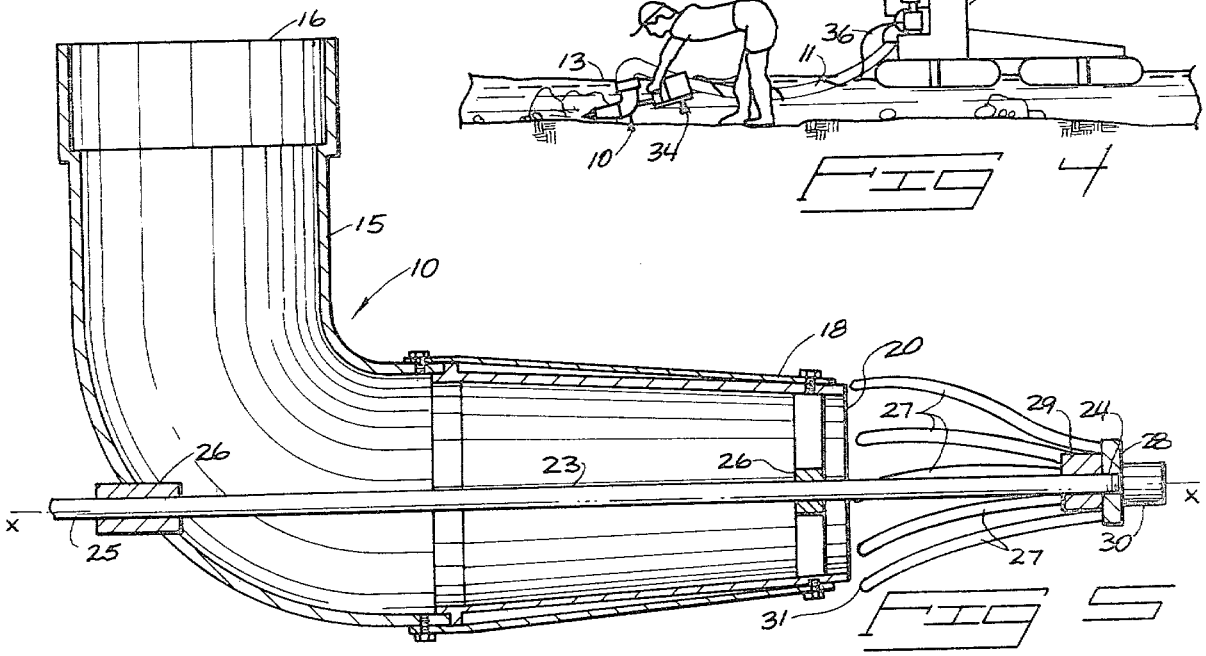
FIG. 5 is an enlarged sectional view taken substantially along line 5—5 in FIG. 1.

The lower or horizontal leg of the elbow 15 is formed along a center axis that appears at line X—X in FIG. 5. The axis X—X passes through the elbow 15 from the opening 20 and intersects the outer diameter of the elbow bend. The opening 20 is centered on the axis.

A shaft 23 is journalled within the elbow 15 to rotate coaxially about axis X—X. The shaft 23 is elongated, having a front threaded end 24 and a rear end 25. Bearings 26 (FIG. 5) are provided as means for rotatably mounting the shaft within the elbow on the axis. The bearings also position the shaft along its length so the front end 24 projects forwardly from the elbow intake end and the rear end 25 projects through the elbow at a point between its ends. Bearings 26 are shown merely as sleeves for illustrative purposes. However, other bearing configurations are envisioned and can be employed.

Figure 1:
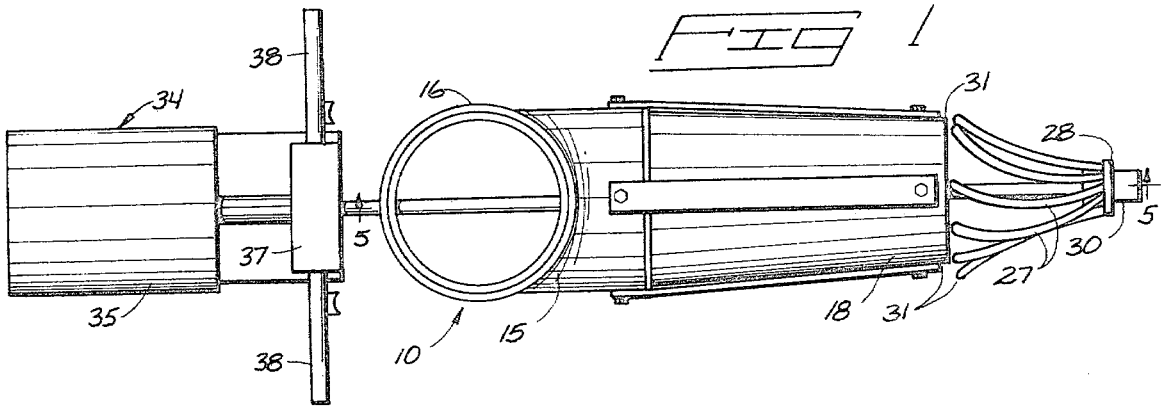
FIG. 1 is a top plan view of the present invention.
Figure 3:
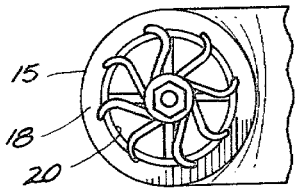
FIG. 3 is a fragmentary end view.
Figure 2:
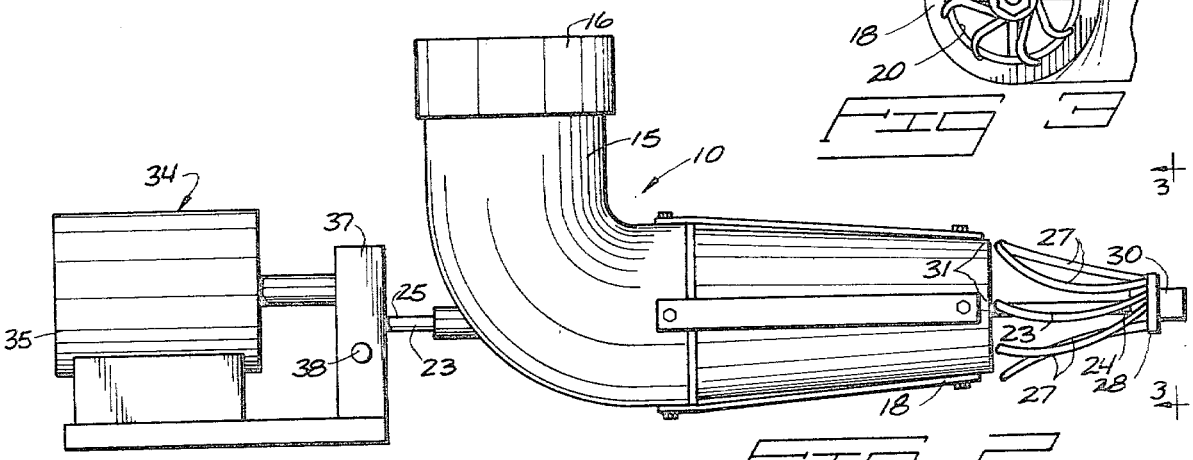
FIG. 2 is a side elevation view thereof.

The front shaft end 24 mounts a plurality of fingers 27. Each of the fingers 27 is bent in a spiral shape (see FIG. 3). All are bent in a common direction of rotation and are spaced equally about the axis. The fingers are mounted or rigidly fixed to a collar 28 received on the shaft 23. This collar 28 is urged against a stop 29 on the shaft and is held in place by a nut 30. The collar 28 therefore mounts the fingers 27 for coaxial rotation about axis X—X forward of the elbow intake end 18.

The specific arrangement of the fingers 27 on the sleeve 28 is important in relation to the positioning and size of the opening 20. Specifically, the fingers 27 are cone shaped, axially diverging from a point at the collar 28 to an open base at free finger ends 31. The "cone base" defined by the fingers is closely adjacent the periphery of opening 20. The base "diameter" may be slightly larger than the diameter of the opening 20 so the finger will radially overlap the opening.

The fingers 27 are preferably formed of a spring material so they will deflect stones or other material that will not freely pass between adjacent fingers. The spiral shaped fingers will also flex to avoid binding against larger irregular rocks or other material that would otherwise jam between the rotating fingers and elbow 15.

Deflected material can readily escape engagement from the fingers and therefore avoid clogging the intake as the fingers deflect and diverge from one another to open rearwardly at the free ends 31 to discharge any engaged material.

The fingers are driven to rotate about the axis X—X by a drive means 34. Means 34 is generally shown including a submersible motor 35. This motor 35 may be of the type conventionally used for small electric outboard boat motors, though other forms of submersible motors can be used. The motor is supplied with electrical energy through an insulated cord 36 (FIG. 4) that extends along the length of the suction hose 11 to a generator or battery mounted to the dredging machine 12.

The motor 35 is connected through an integral or separate gear box 37 directly to the shaft 23. The motor may be mounted to the elbow 15 but is preferably mounted only to the shaft 23. The motor frame is supplied with outwardly projecting handlebars 38 that allows manual manipulation of the inlet 10 by the user (FIG. 4). Control at this location allows selective pivotal movement of the elbow about the axis X—X relative to the motor and handles so the user can position the suction hose 11 to one side or the other without turning the handlebars. Appropriate switching mechanisms can be supplied on the handlebars for operator use in activating the motor 35.

During operation, the user holds the handlebars 38 to position inlet 10 at a selected orientation relative to a submerged surface. He may then operate a convenient switch to initiate operation of the drive means 34. This causes corresponding rotation of the fingers 27. The rotating fingers 27 engage and deflect material outwardly of the open end 20 which would otherwise possibly clog either the elbow 15 or the suction hose 11. The fingers, being flexible along their lengths and having free ends 31, will deflect when engaging hard objects such as large stones and will not be damaged thereby. Furthermore, the flexible fingers will urge material out and rearwardly between the free finger ends to positions clear of the intake opening 20.

The above description and attached drawings have been given by way of example to set forth a preferred form of the present invention. The scope of the invention, however, is more precisely set out in the following claims.

What I claim is:

1. A liquid inlet for the open end of a small, portable dredge having a hand-operated flexible suction hose, comprising:

a hollow tubular elbow having a rear discharge end adapted to be mounted to the open suction hose end, and an angularly displaced forward intake end having a forwardly facing opening centered about an axis;

a straight elongated shaft having a front end and a rear end;

bearing means located within the hollow tubular elbow mounting the elongated shaft between its respective ends for free coaxial rotation about said axis with the front shaft end located forward of the elbow intake end and with the rear shaft end projecting through the elbow at a point between the tube ends;

drive means operably connected to said shaft for rotating the shaft about said axis; and a plurality of identical spiral-shaped spring metal fingers diverging rearwardly from a common connection at the shaft front end rearward to free ends positioned axially adjacent to and radially overlapping the forward intake end of the elbow;

said spiral shaped fingers being equally spaced about the axis and defining a cone centered on the axis extending from a location at the shaft front end rearward to a base adjacent to the forward intake end of the elbow.

2. The liquid inlet as defined by claim 1 wherein the fingers are all affixed to a common sleeve which is removably mounted to the shaft.

3. The liquid inlet as defined by claim 1 further comprising:

handle means connected to the drive means adjacent the shaft at its rear end for allowing hand manipulation of the inlet.

4. The liquid inlet as defined by claim 1 wherein the drive means includes a submersible motor mounted to the rear end of the shaft and spaced clear of the elbow.

5. The liquid inlet as defined by claim 4 further comprising handle means mounted to the motor and adjacent the elbow for allowing hand manipulation of the inlet.

* * * * *